US007691232B2

(12) United States Patent
Kurtz et al.

(10) Patent No.: US 7,691,232 B2
(45) Date of Patent: Apr. 6, 2010

(54) METHOD AND DEVICE FOR TREATING A PAPER OR CARDBOARD WEB

(75) Inventors: Ruediger Kurtz, Heidenheim (DE); Joerg Rheims, Toenisvorst (DE)

(73) Assignee: Voith Paper Patent GmbH, Heidenheim (DE)

( * ) Notice: Subject to any disclaimer, the term of this patent is extended or adjusted under 35 U.S.C. 154(b) by 1213 days.

(21) Appl. No.: 11/067,707

(22) Filed: Mar. 1, 2005

(65) Prior Publication Data

US 2005/0194112 A1 Sep. 8, 2005

(30) Foreign Application Priority Data

Mar. 6, 2004 (DE) ..... 10 2004 010 894

(51) Int. Cl.
*D21H 25/06* (2006.01)
*D21G 1/02* (2006.01)
*D21H 19/00* (2006.01)
*B05D 3/00* (2006.01)

(52) U.S. Cl. ..... 162/136; 162/206; 162/265; 162/361; 118/116; 118/122; 427/361; 427/365; 427/366

(58) Field of Classification Search ..... 162/204–207, 162/358.1, 361, 135–137, 265; 100/156, 100/160, 73–75; 118/116–119, 121–123, 118/126; 427/361, 365, 366, 377
See application file for complete search history.

(56) References Cited

U.S. PATENT DOCUMENTS 5,269,983 A 12/1993 Schulz
5,483,873 A * 1/1996 Koivukunnas et al. ..... 100/38
5,651,863 A 7/1997 Van Haag et al.
5,789,031 A * 8/1998 Hirabayashi et al. ..... 427/341
6,022,448 A * 2/2000 Eriksson et al. ..... 162/123
6,332,953 B1 * 12/2001 Singh et al. ..... 162/123
6,497,790 B2 * 12/2002 Mohan et al. ..... 162/206
6,698,342 B1 3/2004 Heikkinen et al.
6,811,654 B1 * 11/2004 Kytonen et al. ..... 162/358.3
2002/0101310 A1 8/2002 Jennings
2002/0117498 A1 8/2002 Jennings
2002/0121513 A1 9/2002 Jennings
2003/0089706 A1 5/2003 Jennings (Continued)

FOREIGN PATENT DOCUMENTS

DE 102 39 907 3/2004

(Continued)

OTHER PUBLICATIONS

JP 02-160993, Jun. 1990, English language translation (machine translation).*

(Continued)

*Primary Examiner*—Eric Hug
(74) *Attorney, Agent, or Firm*—Greenblum & Bernstein, P.L.C.

(57) ABSTRACT

A method and a device for treating a web, wherein the web is coated by a coating device. The coated web is calendered, and a steam application device applies steam to the coated web before the coated web is calendered. The instant abstract is neither intended to define the invention disclosed in this specification nor intended to limit the scope of the invention in any way.

20 Claims, 1 Drawing Sheet

U.S. PATENT DOCUMENTS

| | | | |
|---|---|---|---|
| 2004/0025720 | A1 | 2/2004 | Heikkinen et al. |
| 2004/0083910 | A1 | 5/2004 | Heikkinen et al. |

FOREIGN PATENT DOCUMENTS

| | | | |
|---|---|---|---|
| EP | 0498623 | | 8/1992 |
| EP | 1 086 272 | | 3/2001 |
| EP | 1491680 | | 12/2004 |
| JP | 2-160993 | * | 6/1990 |
| JP | 4-361686 | * | 12/1992 |
| JP | 4-366697 | * | 12/1992 |
| JP | 5-321193 | * | 12/1993 |
| JP | 2003-227089 | * | 8/2003 |
| WO | 99/64672 | | 12/1999 |
| WO | 00/17446 | | 3/2000 |
| WO | WO 00/70146 | * | 11/2000 |
| WO | 01/23666 | | 4/2001 |
| WO | 01/75224 | | 10/2001 |
| WO | WO 02/12620 | * | 2/2002 |
| WO | 02/29159 | | 4/2002 |
| WO | 02/062104 | | 8/2002 |
| WO | 02/092908 | | 11/2002 |

OTHER PUBLICATIONS

JP 04-361686, Dec. 1992, English language translation (machine translation).*

JP 04-366697, Dec. 1992, English language translation (machine translation).*

Smook, G. A., Handbook for Pulp & Paper Technologists, Angus Wilde Publications, Chapter 18, pp. 283-296 (1992).*

JP 2003-227089, Aug. 2003, full English translation.*

* cited by examiner

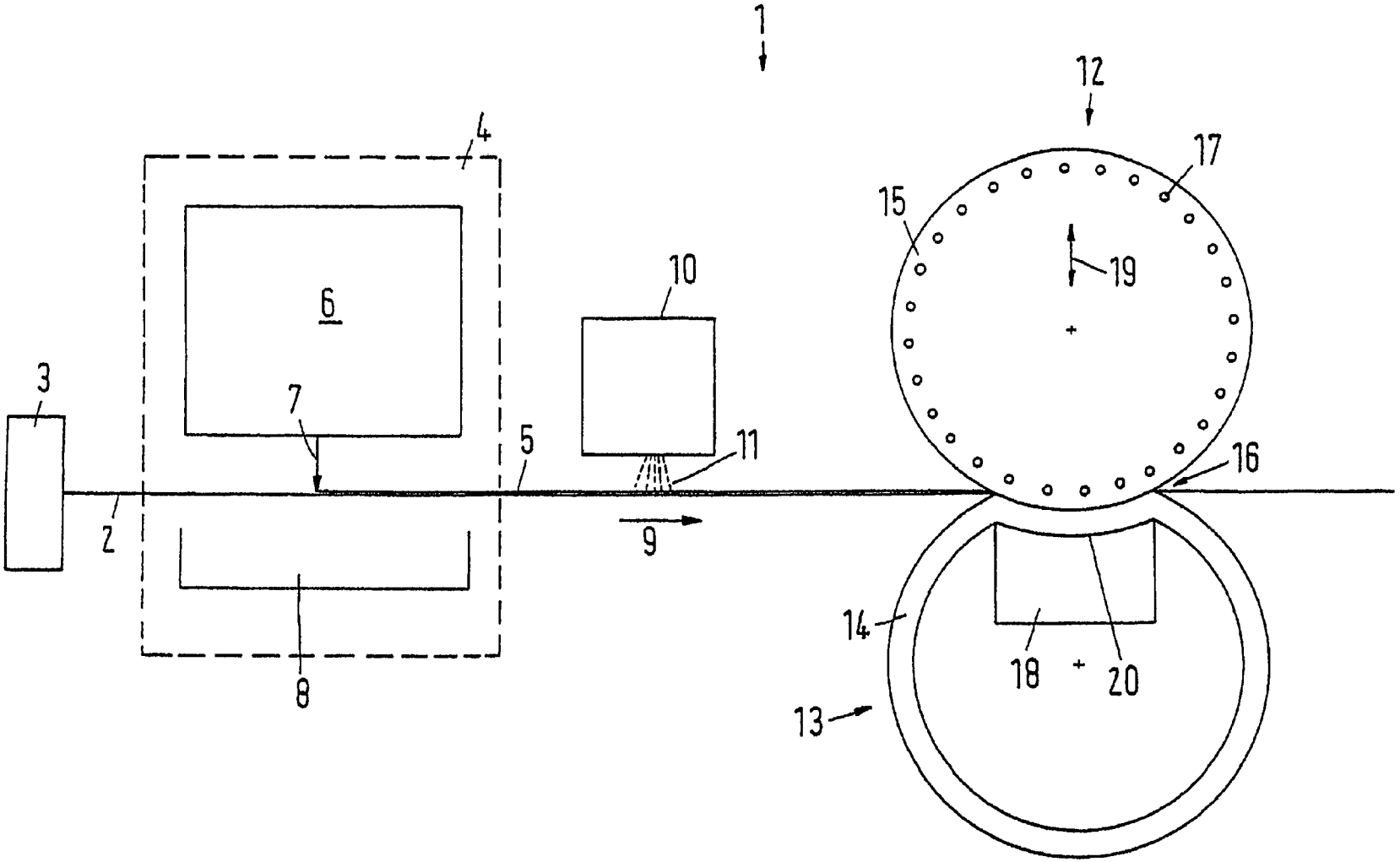
1
2
3
4
5
6
7
8
9
10
11
12
13
14
15
16
17
18
19
20

METHOD AND DEVICE FOR TREATING A PAPER OR CARDBOARD WEB

CROSS-REFERENCE TO RELATED APPLICATIONS

The present application claims priority under 35 U.S.C. §119 of German Patent Application No. 10 2004 010 894.3, filed on Mar. 6, 2004, the disclosure of which is expressly incorporated by reference herein in its entirety.

BACKGROUND OF THE INVENTION

1. Field of the Invention

The invention relates to a method for treating a paper or cardboard web, in which method a coat is applied to a web and the web is then glazed. The invention further relates to a device for treating a paper or cardboard web with a coating device and a calender.

2. Discussion of Background Information

Paper and cardboard webs are often coated, i.e., provided with a coating. The coat, also referred to as "coating composition," is used to give the web a better surface property. In particular the gloss and/or smoothness at the coated surface of the web, i.e., the surface provided with a coating, can be improved with a coat.

After the application of the coat, the surface of the web is often still relatively coarse. Therefore, the web must be glazed to achieve again certain smoothness values and to fix the coat to the web. To this end, relatively high compressive stresses and often also relatively high temperatures are required. This renders glazing a relatively high-expenditure process.

With non-coated papers, the compressive stresses in the calender nip and thus the strains on the web can be reduced by moistening the web before the entry into a nip. To this end, the web is frequently guided through a supercalender if high gloss and smoothness values are desired. With more simply designed webs, a machine calender or soft calender is also sufficient, in which the web is guided through merely one to four hard or soft nips, which are embodied in roll stacks featuring two or three rolls each.

To date, any attempts to improve the glazing result of coated webs through the use of steam have failed. As soon as steam is applied to the coat, the coat becomes sticky and in the calender adheres to the roll, against which the coated side of the web lies. Typically, this is a hard, heated roll. Within the shortest of times this roll is then soiled to such an extent that the glazing or the smoothing process must be interrupted. Therefore, such a procedure has proven to be unsuitable in practice.

Consequently, with coated papers, it is still necessary to operate without a moistening device, but with relatively high line loads and the ensuing relatively high compressive stresses; with higher-quality papers, even with a supercalender which requires a correspondingly high number of rolls. This has so far been the only way to achieve the desired high gloss and smoothness values. But the high line loads have the disadvantage that the web is greatly condensed and that the volume and stiffness of the papers decrease considerably.

SUMMARY OF THE INVENTION

The present invention glazes a coated web with high smoothness and in a volume-conserving manner.

The invention provides a method of the type mentioned at the outset that includes steaming the web before glazing and glazing in a wide nip.

Surprisingly, it has turned out that the steaming of the web even on the coated side is harmless if the web is glazed in a wide-nip calender. A wide-nip calender features a nip that features a much greater length in the travel direction of the web than a nip formed between two rolls. It has not yet been clarified completely why the steaming of coated webs works in conjunction with a wide-nip calender. It is presumed that a wide nip, in contrast to a nip formed between two rolls, allows steam to enter, so that a kind of "protective film" can form between the coat and the roll against which the coated side lies. This protective film then prevents the coat from adhering to the roll. At the same time, the steam cannot condense on the web because of the high temperature, but no additional moistening of the coating layer occurs.

Preferably, the glazing is carried out online with the application of the coat. A coat application device, a steam application device and a wide-nip calender are thus arranged along the web travel path. First, this means a handling can be omitted that is connected to a winding of the web between the coat application and the glazing. But, in addition, this also provides the advantage that the coat has not yet completely "hardened" when passing through the wide nip, so that the coat can be deformed more easily also under the effect of the applied steam. Thereby, the smoothing effect of the wide nip is improved considerably.

Preferably, a wide nip is used with a length in the range of 30 to 400 mm, in particular in the range of 40 to 100 mm for coated types of graphic paper and of 100 to 200 mm for coated types of cardboard. With such a nip length, it can be ensured with great reliability that the coat does not adhere to the roll.

Preferably, the web is glazed in a shoe calender featuring a shoe roll having a rotating jacket and an opposing roll. The opposing roll is operated at a surface temperature in the range of 130 to 300° C., in particular in the range of 170 to 250° C. At least in the intake and discharge areas, the opposing roll thus has a temperature above the steam temperature of water. It is thus achieved that the moisture contained in the coat or the moisture that has been applied additionally through the steam can evaporate in the wide nip. On the one hand, the compressive stresses in the wide nip are here so high that the steam cannot tear the surface of the applied coat, but on the other hand, a protective layer can still form, which prevents the coat from adhering to the opposing roll.

Preferably, the maximum compressive stress in the wide nip is set at below 20 MPa. Through the application of steam, sufficient gloss and smoothness values are achieved even with this relatively low compressive stress. On the other hand, this low compressive stress prevents the coat from adhering to the opposing roll.

Preferably, a retention period of the web in the nip is set at between 0.8 and 50 ms. This retention period suffices to smooth the coated surface of the web to an adequate extent. With cardboard, the retention period will be rather longer, with graphic papers rather shorter.

It is also advantageous to steam the web 10 to 100 ms before the entry into the wide nip. The steam then has sufficient time to react with the applied coat, i.e., to prepare it to such an extent that the desired smoothness can be produced in the wide nip.

Preferably, a pressure gradient of a maximum of 2 MPa/mm is produced in the intake and discharge areas of the wide nip. The length of the intake and discharge areas is generally in the order of magnitude of approximately 10 mm each. In other words, the compressive stress in the wide nip increases at the most by 2 MPa per mm. As a consequence, the steam adhering to the web or having already condensed there can also penetrate into the wide nip. The wide nip thus does not form a steam barrier, as it is the case with two opposite rolls because of a relatively large pressure gradient.

The invention provides a device of the type mentioned at the outset that includes a steam application device arranged between the coating device and the calender. The calender can be embodied as a wide-nip calender.

On the one hand, the interaction of the steam application device with the wide-nip calender has the effect of giving the coated surface of the web a sufficient smoothness and, if necessary, also a sufficient gloss. But on the other hand, it is ensured that the coat does not adhere to a roll of the calender. There is thus no need to fear that the coat will separate from the web and soil the calender. With the wide nip, it is thus possible to achieve a sufficient quality improvement of the coated surface of the web without having to put up with any noticeable volume losses of the web.

Preferably, the length of the wide nip is in the range of 30 to 400 mm, in particular of 40 to 100 mm for coated types of graphic paper and of 100 to 200 mm for coated types of cardboard. Such a length suffices to glaze the web in an adequate manner even if only relatively low compressive stresses are used.

Preferably, the wide-nip calender features a shoe roll with a rotating jacket and an opposing roll interacting with it. The jacket of the shoe roll is supported by a contact shoe. The jacket rotates in the manner of a roll and is thereby deformed in the area of the opposing roll and the contact shoe from its otherwise convex shape into a concave shape. This is a relatively simple embodiment to realize a wide-nip calender. With the rotating jacket, wide nips of sufficient length can be realized.

Preferably, the opposing roll features a temperature in the range of 130 to 300° C., in particular in the range of 170 to 250° C. As explained above, the surface temperature of the opposing roll is thus relatively high. Moisture contained in the coat application is thus heated to a correspondingly high level so that it can possibly form a protective film which prevents the coat from adhering to the opposing roll. Possibly, the adhering of the coat to the opposing roll is also prevented by the fact that the coat can dry out because of the prevailing relatively high temperatures and is no longer prone to be sticky.

Preferably, the maximum compressive stress in the wide nip amounts to 20 MPa. Although this is a relatively low compressive stress, it suffices to smooth the coated side of the web. Possibly, it also allows steam, which has not yet condensed completely on the web after the application, to enter into the wide nip as well, not to condense further there and to form a barrier layer against sticking.

Preferably, the compressive stress increases in the intake and discharge areas of the wide nip at a gradient of a maximum of 2 MPa/mm. The limitation of the increase in compressive stress is also advantageous for the entry of the steam into the wide nip.

Preferably, the steam application device is arranged in the area between 0.3 and 1.5 m before the entry into the wide nip. Depending on the speed of the web, which can be in the range of approximately 250 m/min (cardboard at 400 g/m$^2$) to some 2,500 m/min (graphic, papers, e.g., LWC 50 g/m$^2$), the steam has caused a certain moistening of the coated surface of the web by then. But it is still definitely to be expected that the entire steam has not condensed, so that a part of the steam is possibly conveyed into the wide nip as well and prevents the coat from adhering to the opposing roll there.

The present invention is directed to a process for a web that includes coating a web, calendering the coated web, such that steam is applied to the coated web before the calendering.

According to another feature of the invention, the coated web is calendered in a wide nip calender. The wide nip has a length in the range of 30 mm to 400 mm. When the coated web is graphic paper, the wide nip has a length in the range of 40 mm to 400 mm. Wherein, the coated web is cardboard, the wide nip has a length in the range of 100 mm to 200 mm. Further, the wide nip calender includes a shoe roll with a rotating jacket and an opposing roll interacting with it, such that the opposing roll has a surface temperature in the range of 130° C. to 300° C. The opposing roll can have a surface temperature substantially in the range of 170° C. to 250° C. Further still, the wide nip maximum compressive stresses setting is below 20 MPa. The setting of the retention period of the web in the nip is between 0.8 ms and 50 ms.

According to another feature of the invention, a process where the steam is applied 10 ms to 100 ms before the web enters into the wide nip, there is a pressure gradient with a maximum of 2 MPa/mm in the intake and discharge areas of the wide nip.

According to another feature of the invention, a device for treating a web includes a coating device, a calender and a steam application device positioned between the coating device and the calender. The calender is a wide nip calender. Further, the device includes a length of the wide nip in the range of 30 mm to 400 mm. When the web is graphic paper, the length of the wide nip is substantially in the range of 40 mm to 400 mm. When the web is cardboard, the length of the wide nip is substantially in the range of 100 mm to 200 mm. Further still, the wide nip calender has a shoe roll composed of a rotating jacket and an opposing roll, such that the opposing roll has a surface temperature in the range of 130° C. to 300° C. The opposing roll can have a surface temperature in the range of 170° C. to 250° C. The wide nip calender can be structured and arranged to have a maximum compressive stress in the wide nip of 20 MPa. The wide nip has an intake area and a discharge area, such that wide nip is structured and arranged to increase compressive stress in the intake and discharge areas at a gradient of a maximum of 2 MPa/mm.

According to another feature of the invention, the steam application device is arranged about 0.3 m to 1.5 m before the web enters a calendering nip of the calender.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawing by way of non-limiting example of an exemplary embodiment of the present invention, and wherein: the FIGURE shows a device for treating a web.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A device 1 presented in the FIGURE serves to treat a web 2 of paper or cardboard. The web 2 comes from a paper or cardboard machine 3, which is represented only diagrammatically. It is also possible to unwind the web 2 from a storage roll, e.g., a jumbo roll.

The web 2 first passes through a coating device 4, in which a coat 5 is applied to a surface of the web 2. In the represented exemplary embodiment this is the upper side. The coat 5 is represented here with exaggerated thickness.

The coating device 4 is embodied as "curtain coater", i.e., it features a coat dispensing device 6 that applies a coating medium, i.e., a coating composition or coat pigments, in the form of a curtain 7 to the surface of the web 2. Through an adjustment of the amount of the coating composition dispensed and of the speed of the web 2, the thickness of the coat 5 can be adjusted relatively exactly. In the FIGURE, the thickness of the coat 5 has been represented in an exaggeratedly large manner for reasons of clarity. Coating composition that is not retained by the web 2, e.g., because the curtain 7 is too wide, is collected in a collecting pan 8 and fed back again to the coat dispensing device 6. In a manner not represented in detail, drying devices, which dry the applied coat, are also arranged behind the coat dispensing device 6. These drying devices may operate with infrared, hot air, drying cylinders or other means. While the exemplary embodiment depicts a certain coater, it is understood that other coating devices can be utilized without departing from the scope of the invention.

In the travel direction 9 behind the coating device 4, a steam application device 10 is arranged, which applies steam 11 to the side of the web 2 that is provided with the coat 5.

In the web travel direction 9 behind the steam application device 10, a wide-nip calender 12 is arranged, which is also referred to as a "shoe calender."

The wide-nip calender 12 features a shoe roll 13 with a rotating jacket 14. The jacket 14 interacts with an opposing roll 15 and forms a wide nip 16, in which the web 2 is glazed, i.e., exposed to a certain pressure and a raised temperature.

The opposing roll 15 features a large number of peripheral boreholes 17, through which a heat transfer medium, e.g., oil or steam, can be guided to provide the surface of the opposing roll 15 with a surface temperature in the range of 130 to 300° C., preferably in the range of 170 to 250° C. Instead of the peripheral boreholes 17, of course other options can be used as well to heat the surface of the opposing roll 15, e.g., an induction heating or an infrared heating system.

The shoe roll 13 features a contact shoe 18 that is arranged in a stationary manner. To close the wide nip 16, the opposing roll 15 is lowered in the direction of a double arrow 19, whereby the jacket 14 is supported by a pressure surface 20 of the contact shoe 18. In the present exemplary embodiment, the pressure surface 20 has a shape that is adapted to the curve of the opposing roll 15, taking into account the thickness of the jacket 14. However, this is not absolutely required.

The wide nip 16 has a length in the web travel direction 9 in the range of 30 to 400 mm, in particular in the range of 40 to 100 mm for coated types of graphic paper and of 100 to 200 mm for coated types of cardboard. At a speed of the web 2 in the range of 400 to 2,500 m/min, the web thus needs about 0.8 to 50 ms to pass through the wide nip 16.

Through pressure application device, which are not represented in detail, a compressive stress of a maximum of 20 MPa is now adjusted in the wide nip 16. This compressive stress acts, e.g., approximately in the middle of the wide nip in the web travel direction 9. As of the entry into the wide nip, the compressive stress increases, namely by a maximum of 2 MPa per mm. In other words, the gradient of the compressive stress is limited.

When a coated web has so far been guided through a "normal" calender, the nip of which was formed by two opposite rolls, it turned out that the coat adhered to the roll that touched the coat. In practice, the calender could not be operated.

In the represented embodiment, in which the steam application device 10 is arranged about 0.3 to 1.5 m before the entry into the wide nip 16, this problem does not arise.

It has not yet been clarified completely why the coat 5 does not adhere to the opposing roll 15 in such an embodiment. It is presumed that, because of the relatively short retention period between the application of the steam 11 and the entry of the web 2 into the nip 16, the steam 11 does not condense completely or even condenses just marginally before the nip and a certain part of the steam can also enter into the nip. On account of the raised temperature of the opposing roll 15, the steam cannot condense further there, but forms a barrier layer against sticking. In addition, the coat 5 is dried out due to the prevailing very high temperatures in the nip and then is no longer prone to be sticky.

Thus, a quality-improving steaming of the coated web 2 is achieved without any adhering of the coat 5 to the opposing roll 15.

If a two-sided coat application is desired, then a second coating device, followed by a second wide nip, is arranged in travel direction behind the represented wide nip 16, whereby the coating device then acts on the other side of the web and the hard roll of the subsequent wide nip is in contact with this other side of the web. Between the first wide nip and the subsequent coating device the web is cooled, so that the first coat hardens and the web is again prepared for the steam application.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A process for treating a web, comprising:

applying a coating to a web;

applying steam to the coating while the coating on the web is uncalendered;

calendering the uncalendered coating and web in a shoe calender, wherein the coated web is calendered in a wide nip of the shoe calender, and wherein the steam is applied 10 ms to 100 ms before the web enters into the wide nip; and producing a pressure gradient of a maximum of 2 MPa/mm in intake and discharge areas of the wide nip.

2. The process in accordance with claim 1, wherein the wide nip has a length in the range of 30 mm to 400 mm.

3. The process in accordance with claim 1, wherein the coated web is graphic paper and a length of the wide nip is in the range of 40 mm to 400 mm.

4. The process in accordance with claim 1, wherein the coated web is cardboard and a length of the wide nip is in the range of 100 mm to 200 mm.

5. The process in accordance with claim 1, wherein the wide nip calender includes a shoe roll with a rotating jacket and an opposing roll interacting with it, and the opposing roll has a surface temperature in the range of 130° C. to 300° C.

6. The process in accordance with claim 5, wherein the opposing roll has a surface temperature substantially in the range of 170° C. to 250° C.

7. The process in accordance with claim 1, further comprising setting a maximum compressive stresses of the wide nip below 20 MPa.

8. The process in accordance with claim 1, further comprising setting a retention period of the web in the nip between 0.8 ms and 50 ms.

9. The process in accordance with claim 1, wherein the steam is applied to a top side of the web.

10. A device for treating a web comprising:

a coating device;

a shoe calender having a wide nip with an intake area and a discharge area and being structured and arranged to produce a pressure gradient of a maximum of 2 MPa/mm in the intake and the discharge areas of the wide nip; and a steam application device positioned between said coating device and said shoe calender to apply steam to an uncalendered coating on the web 10 ms to 100 ms before the web enters the wide nip, wherein the coated web is calendered in the wide nip of the shoe calender.

11. The device in accordance with claim 10, wherein a length of the wide nip is in the range of 30 mm to 400 mm.

12. The device in accordance with claim 11, wherein, when the web is graphic paper, the length of the wide nip is substantially in the range of 40 mm to 400 mm.

13. The device in accordance with claim 11, wherein, when the web is cardboard, the length of the wide nip is substantially in the range of 100 mm to 200 mm.

14. The device in accordance with claim 10, wherein said shoe calender comprises a shoe roll composed of a rotating jacket and an opposing roll.

15. The device in accordance with claim 14, wherein said opposing roll comprises a surface temperature in the range of 130° C. to 300° C.

16. The device in accordance with claim 14, wherein said opposing roll comprises a surface temperature in the range of 170° C. to 250° C.

17. The device in accordance with claim 10, wherein said shoe calender is structured and arranged to exhibit a maximum compressive stress in said wide nip of 20 MPa.

18. The device in accordance with claim 10, wherein said steam application device is arranged about 0.3 m to 1.5 m before the web enters a calendering nip of said calender.

19. The device in accordance with claim 10, wherein excess coating from the coating device is collected in a collecting pan and fed back into the coating device.

20. A device for treating a web comprising:

a coating device;

a shoe calender;

a steam application device positioned between said coating device and said shoe calender to apply steam to an uncalendered coating on the web;

a second coating device structured to coat an uncoated side of the web;

a second shoe calender; and a second steam application device positioned between said second coating device and said second calender.

* * * * *